United States Patent [19]

Spaulding

[11] 4,184,736

[45] Jan. 22, 1980

[54] TWO-PIECE CONTACT ASSEMBLY FOR ELECTRICAL CONNECTOR ASSEMBLIES

[75] Inventor: Tedford H. Spaulding, Norridge, Ill.

[73] Assignee: Bunker Ramo Corporation, Oak Brook, Ill.

[21] Appl. No.: 895,170

[22] Filed: Apr. 11, 1978

Related U.S. Application Data

[63] Continuation of Ser. No. 821,620, Aug. 3, 1977, abandoned.

[51] Int. Cl.[2] ..... H01R 13/12

[52] U.S. Cl. ..... 339/258 R; 339/276 T

[58] Field of Search ..... 339/258 R, 258 P, 258 RR, 339/259 R, 262 R, 262 RR, 262 P, 276 R, 276 T

[56] References Cited

U.S. PATENT DOCUMENTS

| | | | |
|---|---|---|---|
| 3,317,887 | 5/1967 | Henschen et al. | 339/276 T |
| 3,721,943 | 3/1973 | Curr | 339/258 P |
| 3,923,367 | 12/1975 | Carter | 339/276 R |

*Primary Examiner*—Joseph H. McGlynn

*Attorney, Agent, or Firm*—William Lohff; F. M. Arbuckle

[57] ABSTRACT

A contact assembly is disclosed including an inner liner and outer shell. The liner has a transverse slot dimensioned to always align with at least one of two inspection apertures on opposite sides of the shell regardless of the rotational orientation of the liner with respect to the shell. Thus, the liner need not be rotationally indexed with the shell during assembly of the contact in order to insure an unobstructed view into the crimp barrel.

14 Claims, 6 Drawing Figures

TWO-PIECE CONTACT ASSEMBLY FOR ELECTRICAL CONNECTOR ASSEMBLIES

This is a continuation of application Ser. No. 821,620, filed Aug. 3, 1977, now abandoned.

BACKGROUND OF THE INVENTION

This invention relates generally to an electrical contact for use in electrical connector assemblies, and more particularly to a two-piece socket contact assembly having a crimp barrel wherein an inspection aperture in an outer shell is open to the interior of the crimp barrel regardless of the rotational orientation of an inner liner with respect to the shell.

Crimping is a well known and common expedient used to interconnect or terminate stranded and solid wire conductors to electrical contacts. Generally, an open crimp barrel is employed with the conductor seated in a generally semicylindrical shell or barrel the sides of which are subsequently folded over or crimped to thereby mechanically retain and electrically connect the conductor to the contact. Another crimping arrangement utilizes a closed crimp barrel which is cylindrical in configuration. In this arrangement the conductor is seated within the barrel by longitudinal insertion through one of the barrel's open ends. In order to determine if the conductor has been seated within the barrel to the proper depth, some prior art crimp contacts have employed one or more inspection apertures on the crimp barrel.

A less common crimp contact arrangement is one which employes an inner crimp liner and an outer cylindrical shell. The outer shell is typically a complete cylinder which holds dimensional tolerances and reduces the possibility of sharp upturned edges after the crimping operation has been effected.

Where the contact assembly comprises two separate pieces, such as a tubular outer shell and a coaxial inner liner, an inspection aperture must be provided in the liner as well as in the shell, and the apertures must align, of course, or the inspection aperture in the shell will be obstructed by the liner. Accordingly, indicia are commonly provided on the shell and the liner for rotationally orienting the liner with respect to the shell. When the shell and the liner are properly oriented, the apertures in the liner and the shell are aligned so that the liner does not obstruct the inspection aperture of the shell. Providing such indica on the shell and the liner and then aligning the indica to orient the liner in the shell, however, increases the cost of the contact—and complicates its assembly.

SUMMARY OF THE INVENTION

The present invention is, therefore, directed to a two-piece contact assembly having an inner liner which is not indexed with respect to the outer shell, but which provides an unobstructed inspection aperture to a closed crimp barrel regardless of the rotational orientation of the liner with respect to the shell.

In accordance with the general concepts of the present invention, a hooded socket contact assembly is provided comprising a tubular shell and an inner liner dimensioned to fit coaxially inside the shell. A pair of inspection holes extend through the shell and a transverse slot is positioned in the liner wall in longitudinal alignment with the two inspection apertures in the shell. The transverse dimension of the slot along the circumference of the cylindrical liner wall is such that the slot is always aligned with at least one of the inspection apertures in the shell regardless of the rotational orientation of the liner relative to the shell.

Thus, the non-indexed two-piece contact assembly of the present invention eliminates the need for indicia to rotationally orient the liner with respect to the shell, simplifying the assembly of two-piece contact assemblies and reducing their cost.

BRIEF DESCRIPTION OF THE DRAWINGS

The novel features that are believed to be characteristic of the invention are set forth in the appended claims. The invention itself, however, with further objects and attendant advantages thereof, will be best understood by reference to the following description taken in conjunction with the accompanying drawings in which:

DETAILED DESCRIPTION OF THE PREFERRED EMBODIMENT

Figure 1:
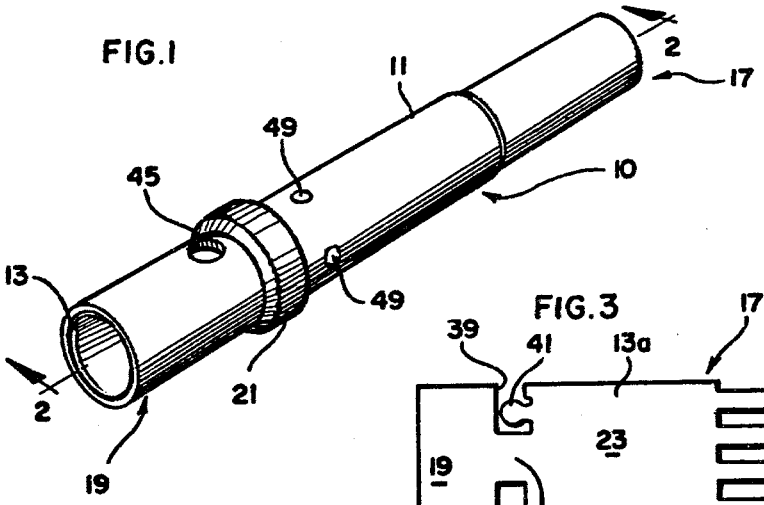
FIG. 1 is a perspective view of a two-piece hooded socket contact assembly having a non-indexed liner and shell wherein at least one of two inspection apertures in the shell is open to the interior of the crimp barrel regardless of the rotational orientation of the liner with respect to the shell.
Figure 2:
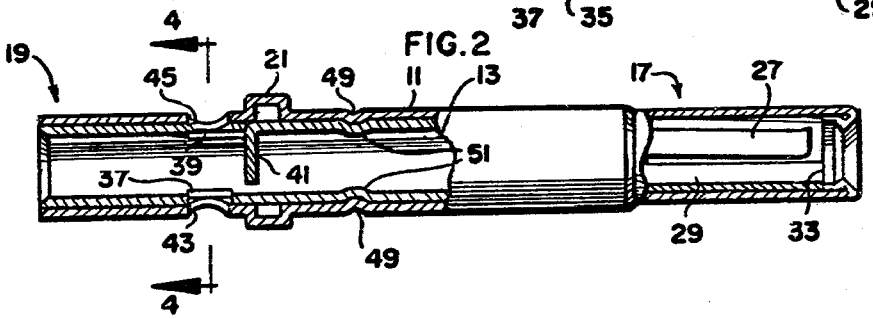
FIG. 2 is a sectional view taken along lines 2—2 in FIG. 1 showing the socket contact assembly in greater detail.

Referring now to FIGS. 1 and 2, the two-piece hooded socket assembly 10 of the present invention is shown to comprise a seamless tubular shell 11 and a separate tubular inner line 13 coaxially mounted therein. In particular, the contact assembly has a forward pin-engaging end, identified generally at 17, for electrically engaging the pin contact of a complementary connector member, and a rear crimp barrel portion at 19 for terminating an electrical conductor. A retaining shoulder 21 is optionally provided on the shell 11 to hold the socket contact in a conventional connector body in which the socket contact may be mounted.

Figure 3:
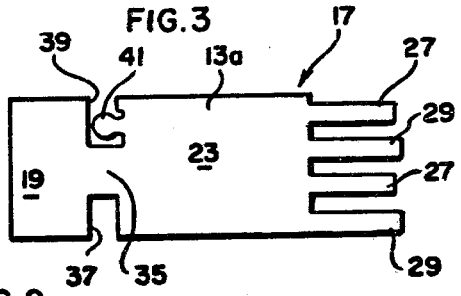
FIG. 3 is a top plan view of a one-piece sheet metal blank from which the inner liner is formed.

The inner liner 13 is formed from a one-piece blank, illustrated in FIG. 3, which is stamped from thin sheet metal, such as cadmium copper or berylium copper. The forward pin-engaging portion 17 formed from the liner blank **13*a* comprises a first rectagular portion, identified generally at 23, having forwardly extending tines 27 for engaging opposite sides of a pin contact. Longer finger-like elements 29 for locating the liner 13 in the shell 11 are also provided at the forward portion 17 of the blank 13*a*. Thus, when the liner 13 formed from the blank is inserted into the shell 11 as shown in FIG. 2, the locating elements 29 abut indexing means comprising a rearwardly directed lip 33 of the shell at the pin-engaging end of the contact to position the ends of the tines 25 and 27** a short distance away from the opening at the forward end of the contact.

Referring again to FIG. 3, the crimp barrel position 19 of the liner blank 13*a* is attached to the rectangular portion 23 by a narrow connecting portion 35. A pair of transverse slots 37 and 39 extend inwardly from the sides of the blank in opposing relation to define and separate the forward pin-engaging portion 17 and the rear crimp barrel portion 19. A tab 41 extends rearwardly into slot 39 from the rectangular portion 23.

After the liner blank 13*a* in FIG. 3 is rolled into the tubular liner 13 in FIG. 2, the tines 25 and 27 are preset inwardly so that the pressure required for good electrical contact will be exerted on any complementary pin contact received in the contact. Also, the tab 41 is bent to depend inwardly from the liner 13 and serve as a stop against which the conductor abuts when properly seated in the crimp barrel 19. Thereafter, the liner 13 is inserted into the shell 11 from the crimp barrel end until the locating elements 29 at the front of the liner abut the rearwardly directed shell lip 33.

Figure 4:
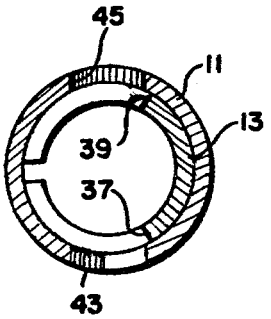
FIG. 4 is a cross-sectional view taken along lines 4—4 in FIG. 2 illustrating a first rotational orientation of the liner with respect to the shell wherein inspection may be made through the liner and the shell of the socket contact into the interior of the crimp barrel.
Figure 5:
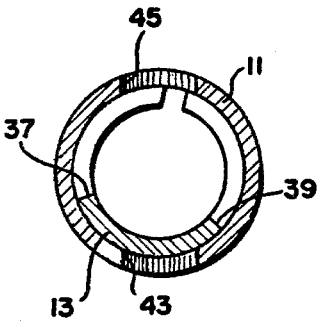
FIG. 5 is a cross-sectional view similar to that of FIG. 4 but with the inner liner has been rotated.
Figure 6:
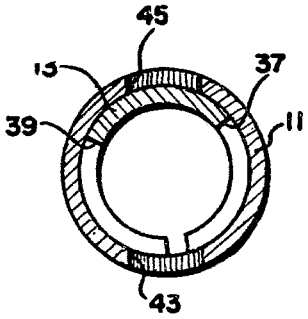
FIG. 6 is another sectional view similar to FIG. 4 wherein the liner has been further rotated.

Inspection apertures 43 and 45 are provided in the crimp barrel portion 19 of the shell 11 to permit inspection into the crimp barrel to ascertain whether the conductor is properly seated within the crimp barrel. When the liner blank 13*a* shown in FIG. 3 is formed into the tubular inner liner, the edges of the blank abut, and the slots 37 and 39 are aligned to provide a single transverse slot in the liner wall. When the liner 13 is assembled in the tubular shell 11, the slot in the liner is longitudinally aligned with the inspection apertures 43 and 45 such that inspection may be made through at least one of the two apertures regardless of the rotational orientation of the liner with respect to the shell. In particular, the combined transverse dimension of the slots 37 and 39 in the liner is at least equal to the sum of one-half the circumference of the liner and the diameter of one inspection aperture. Thus, as illustrated in FIGS. 4 through 6, regardless of the rotational orientation of the liner in the shell, inspection is possible through at least one and, depending on the rotational orientation of the liner, possibily both inspection apertures. That is, at least one inspection aperture in the shell is always unobstructed to permit inspection into the crimp barrel portion of the contact.

When the liner 13 has been fully inserted into the shell 11, inwardly-directed pressure is applied to the wall of the shell at one or more points along its circumference. The resulting indentations, or dimples, 49 and 51 in the shell wall and the liner wall, respectively, secure the liner 13 in the shell 11 and prevent inadvertent disassembly of the contact.

Accordingly, there has been described a two-piece, hooded contact socket assembly having a tubular outer shell and a separate, full length liner wherein inspection of the crimp barrel is provided without rotationally orienting the liner with respect to the shell. That is, at least one inspection hole in the hood is always unobstructed because the slot in the liner has a transverse dimension such that the liner slot is always coincident with at least one inspection hole. Thus, in assembling the socket contact, the liner need not be polarized or indexed with respect to the hood. The socket contact of the present invention also has the added advantage that greater automation can be utilized and assembly is simplified.

Of course, it should be understood that various changes and modifications to the preferred embodiments described herein will be apparent to those skilled in the art. Such changes and modifications can be made without departing from the spirit and scope of the present invention and without diminishing its intended advantages. It is therefore intended that such changes and modifications be covered by the following claims.

I claim:

1. A contact assembly adapted to terminate an electrical conductor at one end and to receive and make electrical connection with a compatible contact member at its other end, said contact assembly comprising:

a tubular shell having a forward contact receiving portion, a rearward crimp barrel portion, and two apertures extending through said shell on generally opposite sides of said crimp barrel portion; and a tubular liner mounted coaxially within said tubular shell and including a forward portion for engaging said compatible contact member and a rearward portion for crimp-terminating said conductor, said liner also including a generally transverse slot longitudinally aligned with said apertures in said shell, said transverse slot extending circumferentially about said liner sufficiently to align with at least one of said apertures in said shell regardless of the rotational orientation of said liner with respect to said shell.

2. The contact assembly of claim 1 wherein said liner includes forwardly extending tines for making electrical contact with said compatible contact member.

3. The contact assembly of claim 1 wherein said transverse slot has a circumferential dimension at least equal to the sum of one-half the circumference of said cylindrical liner and the diameter of one said aperture.

4. The contact assembly of claim 1 further including a tab inwardly depending from said liner for limiting the distance which said conductor can be inserted into said crimp barrel.

5. The contact assembly of claim 4 wherein said tab is located adjacent but forwardly of said aperture.

6. The contact assembly of claim 1 including means for securing said liner in said shell.

7. The contact assembly of claim 6 wherein said securing means comprises a plurality of dimples in said shell extending into and engaging said liner.

8. The contact assembly of claim 1 wherein said shell also includes an indexing means for abutting a stop member on said liner to longitudinally position said liner within said shell.

9. The contact assembly of claim 8 wherein said indexing means comprises a rearwardly directed lip integral with the forward contact receiving portion of said shell.

10. The contact assembly of claim 9 wherein said liner further includes a plurality of forwardly and inwardly extending tines for electrically engaging said pin contact and said stop member comprises at least one forwardly extending element interposed between said tines.

11. A two-piece hooded socket contact assembly adapted to terminate an electrical conductor at one end and to receive and make electrical connection with a pin contact at its other end, said socket contact assembly comprising:

a tubular shell having a forward pin contact receiving portion, a rearward crimp barrel portion, and two apertures extending through said shell on generally opposite sides of said crimp barrel portion; and a tubular liner mounted coaxially within said tubular shell and including a forward portion for engaging said pin contact and a rearward portion for crimp-terminating said conductor, said liner also including a generally transverse slot longitudinally aligned with said apertures in said shell, said transverse slot extending circumferentially about said liner sufficiently to align with at least one of said apertures in said shell regardless of the rotational orientation of said liner with respect to said shell.

12. The contact assembly of claim 11 wherein said shell also includes an indexing means for abutting a stop member on said liner to longitudinally position said liner within said shell.

13. The assembly of claim 12 wherein said indexing means comprises a rearwardly directed lip integral with the forward contact receiving portion of said shell.

14. The assembly of claim 13 wherein said liner further includes a plurality of forwardly and inwardly extending tines for electrically engaging said pin contact and said stop member comprises at least one forwardly extending element interposed between said tines.

* * * * *